US006340800B1

(12) United States Patent
Zhai et al.

(10) Patent No.: US 6,340,800 B1
(45) Date of Patent: Jan. 22, 2002

(54) MULTIPLEXING CONTROL DEVICE AND METHOD FOR ELECTRONIC SYSTEMS

(75) Inventors: Shumin Zhai, San Jose, CA (US); Phillip Edward Partin, Wake Forest, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/580,994

(22) Filed: May 27, 2000

(51) Int. Cl.[7] ..... H01H 3/20
(52) U.S. Cl. ..... 200/5 R; 200/17 R; 200/18
(58) Field of Search ..... 200/1 R, 5 R, 200/4, 6 R, 11 R, 16 R, 17 R, 18, 1 B, 42.01, 563, 566, 318.2, 321, 336, 339

(56) References Cited

U.S. PATENT DOCUMENTS

| | | | | |
|---|---|---|---|---|
| 5,283,401 A | | 2/1994 | Schmucker | 200/6 A |
| 5,516,991 A | | 5/1996 | Hommann | 200/6 R |
| 5,749,617 A | * | 5/1998 | Wissrich et al. | 296/107 |
| 5,902,972 A | | 5/1999 | Nestor et al. | 200/1 B |
| 5,925,860 A | * | 7/1999 | Lee | 200/18 |
| 5,945,646 A | | 8/1999 | Miller et al. | 200/5 R |
| 6,034,337 A | * | 3/2000 | Siegert | 200/50.32 |
| 6,225,578 B1 | * | 5/2001 | Kobayashi et al. | 200/5 R |
| 6,281,453 B1 | * | 8/2001 | Uleski | 200/4 |

OTHER PUBLICATIONS

Dish Network ™ Universal Remote Control, manual 123473388–AA Rev. AB, available on the World Wide Web at URL: http://www.dishnetwork.com/pdf/remote/remote.pdf, printed May 16, 2000, pp. 1–13.
Microsoft (R) Natural (R) Keyboard Pro, brochure, material not dated.

* cited by examiner

*Primary Examiner*—Michael Friedhofer
(74) *Attorney, Agent, or Firm*—Samuel A. Kassatly

(57) ABSTRACT

A compact multiplexing control device combines simplicity with efficiency, ease of use, and quick access, and enables a user to switch among multiple functions. The multiplexing control device is comprised of two main components: a selector and an executor. The selector is a manually rotatable ring labeled with functions. The executor is a rocker which is disposed at a fixed location at the center of the ring. In a resting position, the rocker is aligned with a pair of functions, while in a selection position, the ring is rotated so that the rocker is aligned with a new pair of functions. Once the desired function is aligned with one pad of the rocker, the user can press that pad to execute the selected function.

20 Claims, 9 Drawing Sheets

MULTIPLEXING CONTROL DEVICE AND METHOD FOR ELECTRONIC SYSTEMS

FIELD OF THE INVENTION

The invention relates to the field of control devices, and particularly to a multiplexing control device (MCD) for use in electronic systems, such as computer keyboards, industrial control consoles, remote controls for TVs, VCRs, sound systems, video cameras, car electronic controls, and like applications.

BACKGROUND OF THE INVENTION

As the electronic systems, such as input devices for computers, control consoles, sound systems, video cameras, VCRs, remote controls, electronic systems in cars, and other like devices, are provided with increasingly more sophisticated functionalities, the design of the control devices for these systems is similarly gaining an increasingly more important role. This added complexity would most likely entail adding rows of buttons or keys, and dials. However, the space required for adding such control devices may be unavailable and may render the control device cumbersome to manage. For example, too many buttons on a console might disorient an unsophisticated user, by rendering the task of memorizing the functions of all the control keys more tedious.

A computer keyboard represents a specific illustration of the problems encountered by adding control devices. In general, a keyboard includes two types of keys: alphanumeric keys and functions keys. Many of the functions keys are not frequently used, because they are far from the home row (ASDFGHJKL), and are thus difficult to reach by the typists. As computers have started to integrate a greater number of multimedia devices and functionalities, such as CD players, web browsing, and so forth, more functions keys are needed.

Some recent keyboards, such as Microsoft's® Natural® Keyboard Pro keyboard added a row of multimedia functions keys to the conventional keyboard layout, with each key being exclusively assigned to a specific function. Some of these multimedia functions keys are programmable by the user. However, these control devices suffer from several drawbacks among which are the following:

The added space required to place the multimedia functions keys on the keyboard increases the size the control devices, rendering it bulky and cumbersome.

These multimedia functions keys are even farther removed from the regular functions keys relative to the home row, making these keys less likely to be used while the keyboard is used for its principal intended function, namely typing. An average typist might be required to stop typing, remove one or both hands from the rest typing position, search for the desired control key, press this key, and then restore the hands to the normal typing position.

In addition, an unsophisticated typist may find it difficult to instantaneously locate the desired control key among the multitude of multimedia functions keys, without protracted practice. This demanding complexity adds to the confusion and processing time by a regular user, defeating the purpose of these keys. As a result, several of these new keys might never be used by an average user.

Some of these problems were addressed by U.S. Pat. No. 5,283,401 to Schmucker, that describes a manual control device for selectively actuating one or more switches in a multi-switch system. The control device is utilized with a video entertainment system, multimedia game device or other type system requiring a hand-actuated control apparatus. The device is operable to actuate switches individually or in adjacent pairs, and is capable of both direct and tilt methods of operation, whereby in the tilt method the tilting movement for switch actuation is less than that required in the direct method.

Another example of a conventional multi-switch control device is the multipurpose remote control for TVs, VCRs and sound systems. In one such remote control device, a switch or multiple keys are used to reallocate the assignment of the keys for either a TV, a VCR, a cable box, or an auxiliary system.

However, the foregoing exemplary control devices are geared towards multimedia devices, and may have limited or specialized applications beyond their original intended applications. For instance, these control devices might not be readily incorporated in a keyboard or in a control console for machinery or heavy equipment.

There is currently no adequate control mechanism and associated method that simplify the functionality and reduce the number of input pads in control devices. The need for such a control mechanism has heretofore remained unsatisfied.

SUMMARY OF THE INVENTION

One feature of the present invention is to provide a compact multiplexing control device (MCD) that combines simplicity with efficiency, ease of use, and quick access. The multiplexing control device enables the user to change and switch quickly among multiple functions.

More specifically, the multiplexing control device is comprised of two main components: a selector and an executor. The selector is a manually rotatable ring labeled with functions. The executor is a rocker which is disposed at a fixed location at the center of the ring. In a resting position, the rocker is aligned with a pair of functions. In a selection position, the ring is rotated so that the rocker is aligned with a new pair of functions. Once the desired function is aligned with one end, also referred to herein as pad of the rocker, the user can press that pad to execute the function.

According to another embodiment, the rocker is comprised of a plurality of (i.e., three or more) pads that are disposed within the inner perimeter of the ring. According to yet another embodiment, the rocker is comprised of two or more pads that are disposed outside the periphery of the ring.

The multiplexing control device of the present invention distinguishes itself over conventional devices by its simplicity, ease of use, efficiency, and versatility. Its implementation is not limited to specialized applications, in that it can be easily adapted for use in most electrical and electronic control systems where localized or remote controls are currently in use, and where functions are executed by push-button keys.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF THE INVENTION

Figure 1:
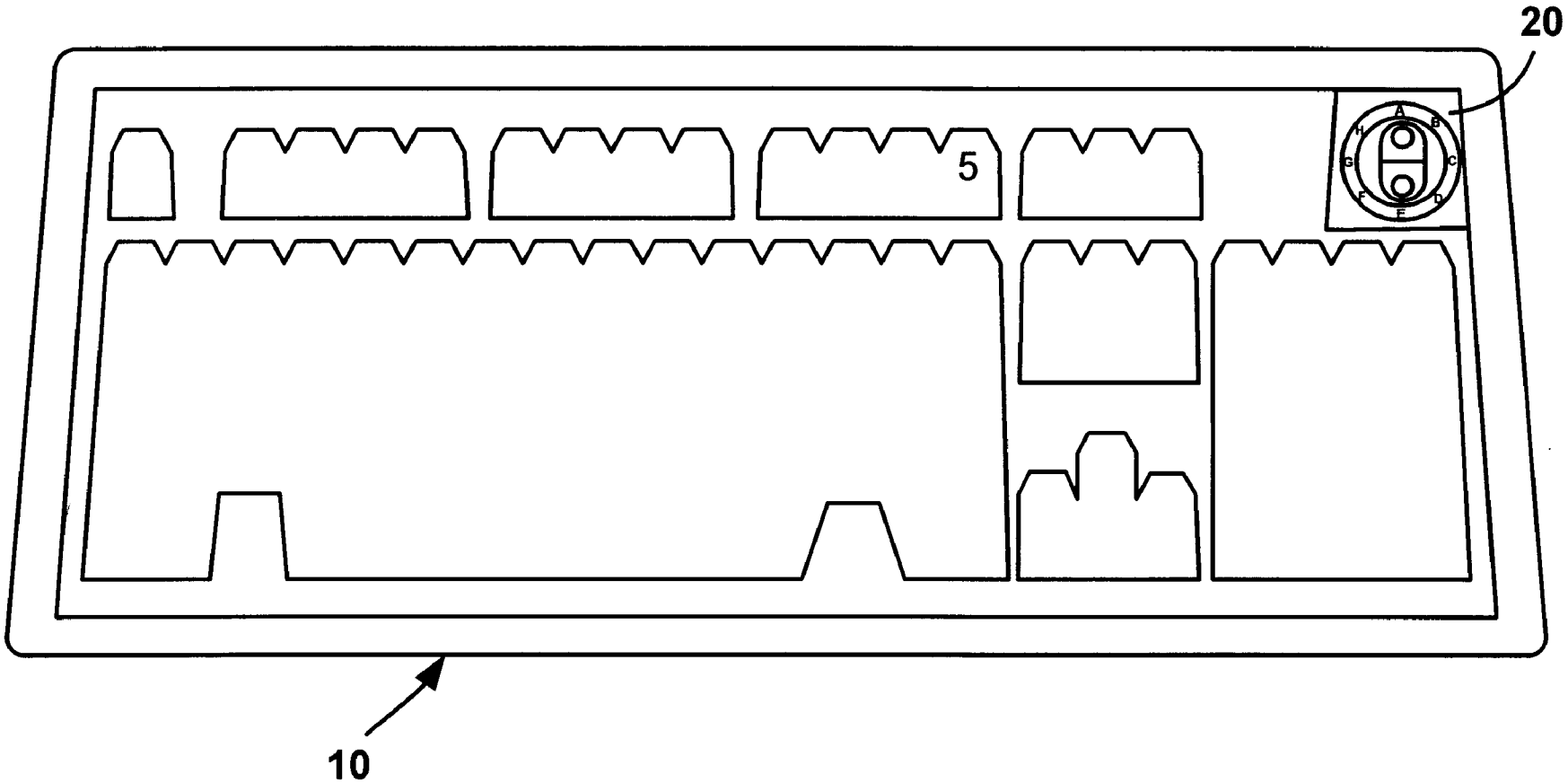
FIG. 1 is a schematic view of a device, illustrated by a keyboard, using a multiplexing control device of the present invention.

FIG. 1 is a schematic view of an input device, illustrated by a keyboard 10 that incorporates a multiplexing control device (MCD) 20 of the present invention. In this exemplary embodiment the multiplexing control device 20 is shown as being integrated with the keyboard 10. It should however be clear that the multiplexing control device 20 can be separate from the keyboard 10. For example, the multiplexing control device 20 can form part of a separate control panel.

Figure 2:
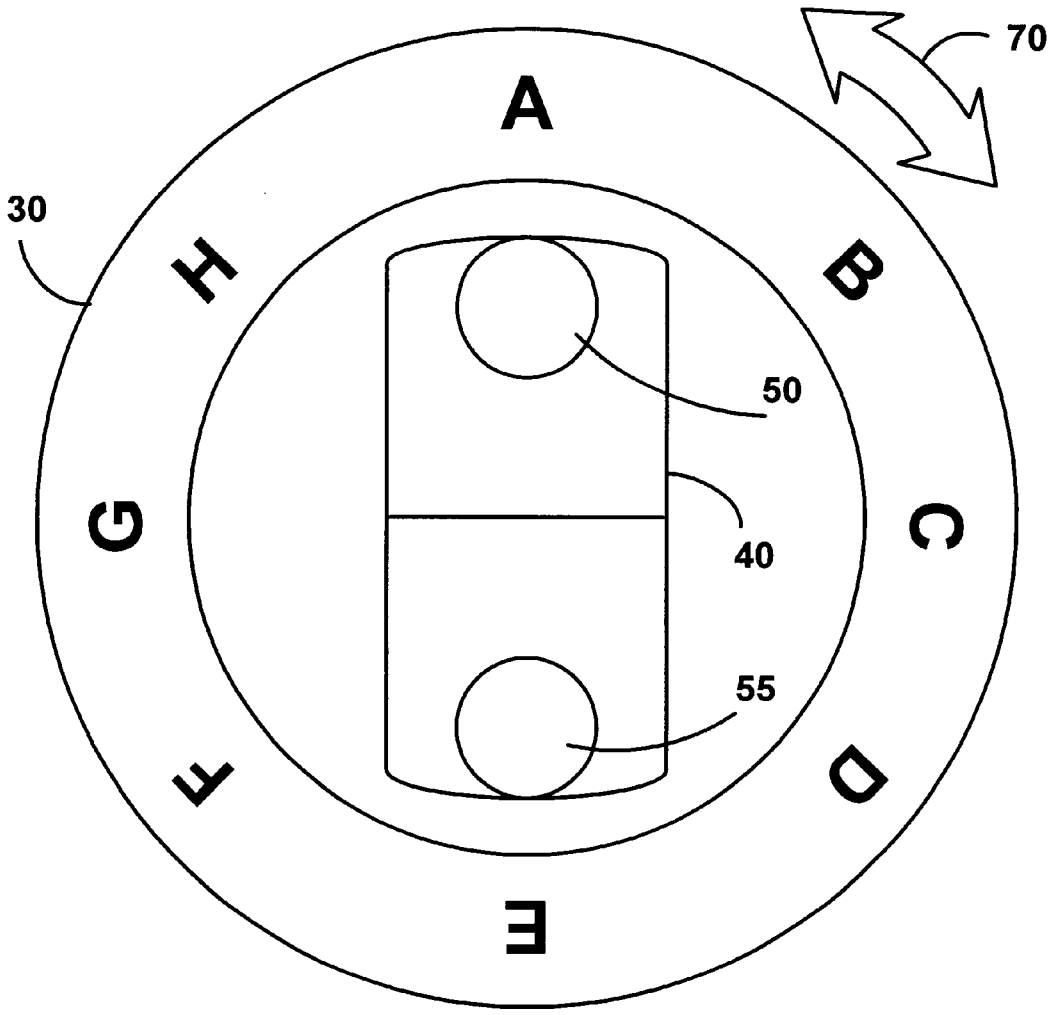
FIG. 2 is an enlarged top view of the multiplexing control device of FIG. 1, shown in a first position.

With reference to FIG. 2, the multiplexing control device 20 is a compact multiplexing input device capable of switching between several functions. The multiplexing control device 20 is comprised of two main components: a selector 30 and an executor 50. In this exemplary embodiment, the selector 30 is a manually rotatable, circular ring 30, which is labeled with multiple functions generally indicated by the letters A, B,C, D, E, F, G and H. Though only eight functions are shown, it should be clear that the multiplexing control device 20 can be provided with a different number of functions. The ring 30 is capable of rotating along the arrow 70.

Figure 2A:
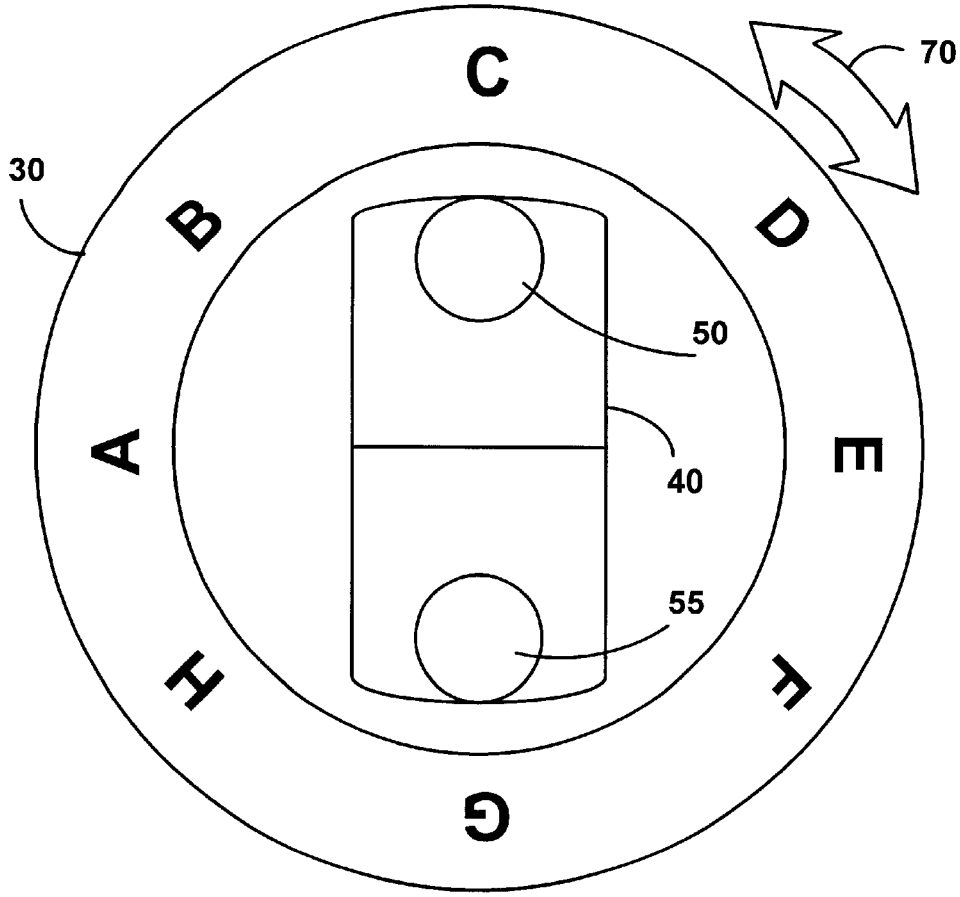
FIG. 2A is a schematic top view of the multiplexing control device of FIG. 2, shown in a second position.

The executor is a rocker 40 disposed at a fixed location within the inner periphery of the ring 30. In this example, the rocker 40 includes two pads 50, 55, wherein in a resting position, the rocker 40 is aligned with a pair of functions, i.e., A and E. In a selection position, the ring 30 is rotated so that the rocker 40 is aligned with a new pair of functions, i.e., C and G (FIG. 2A). Once the desired function is selected, the user presses the pad 50 or 55 of the rocker 40, which is aligned with the desired function, in order to cause this function to be executed.

Figure 3:
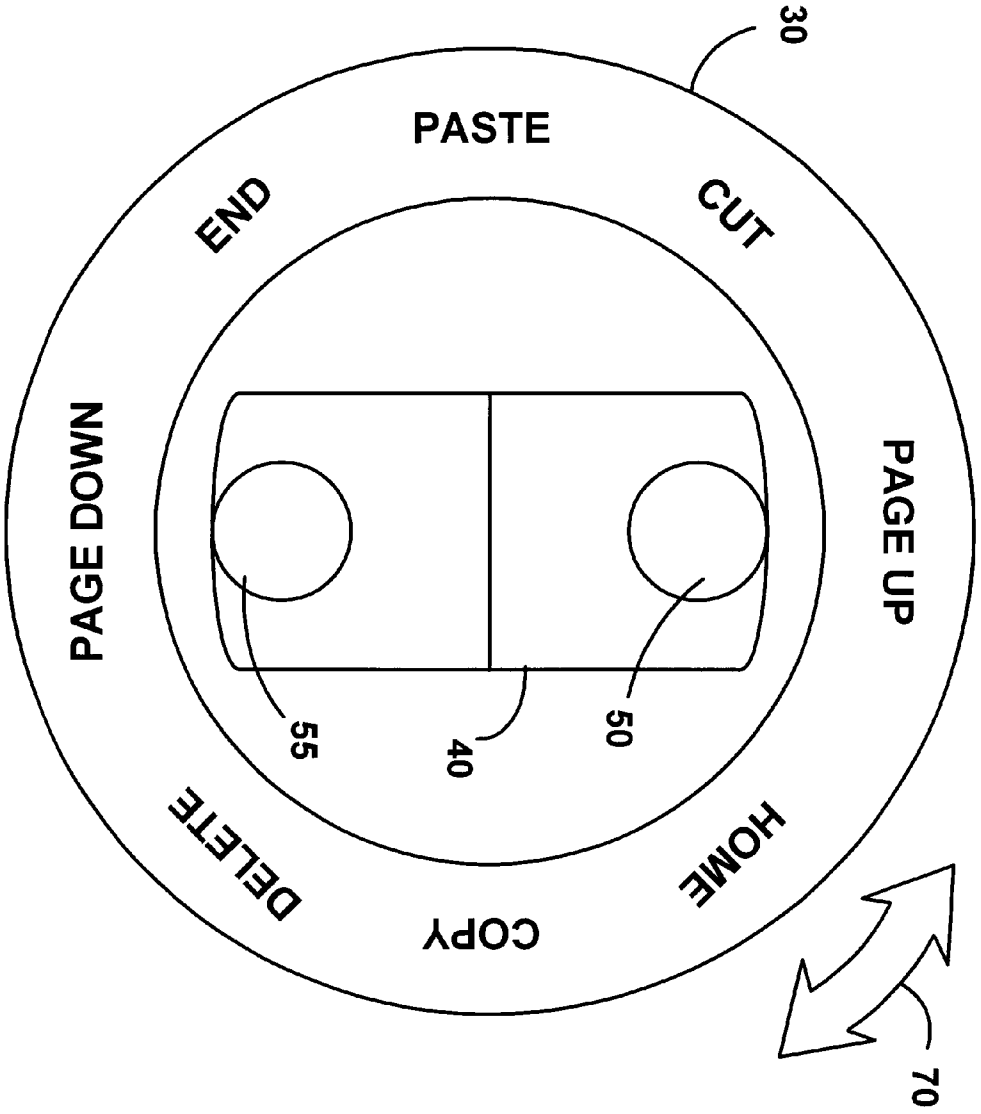
FIG. 3 is a schematic top view of an exemplary embodiment of the multiplexing control device of FIG. 1, that illustrates the use of the multiplexing control device in a keyboard, in conjunction with word processing and web browsing applications.
Figure 3A:
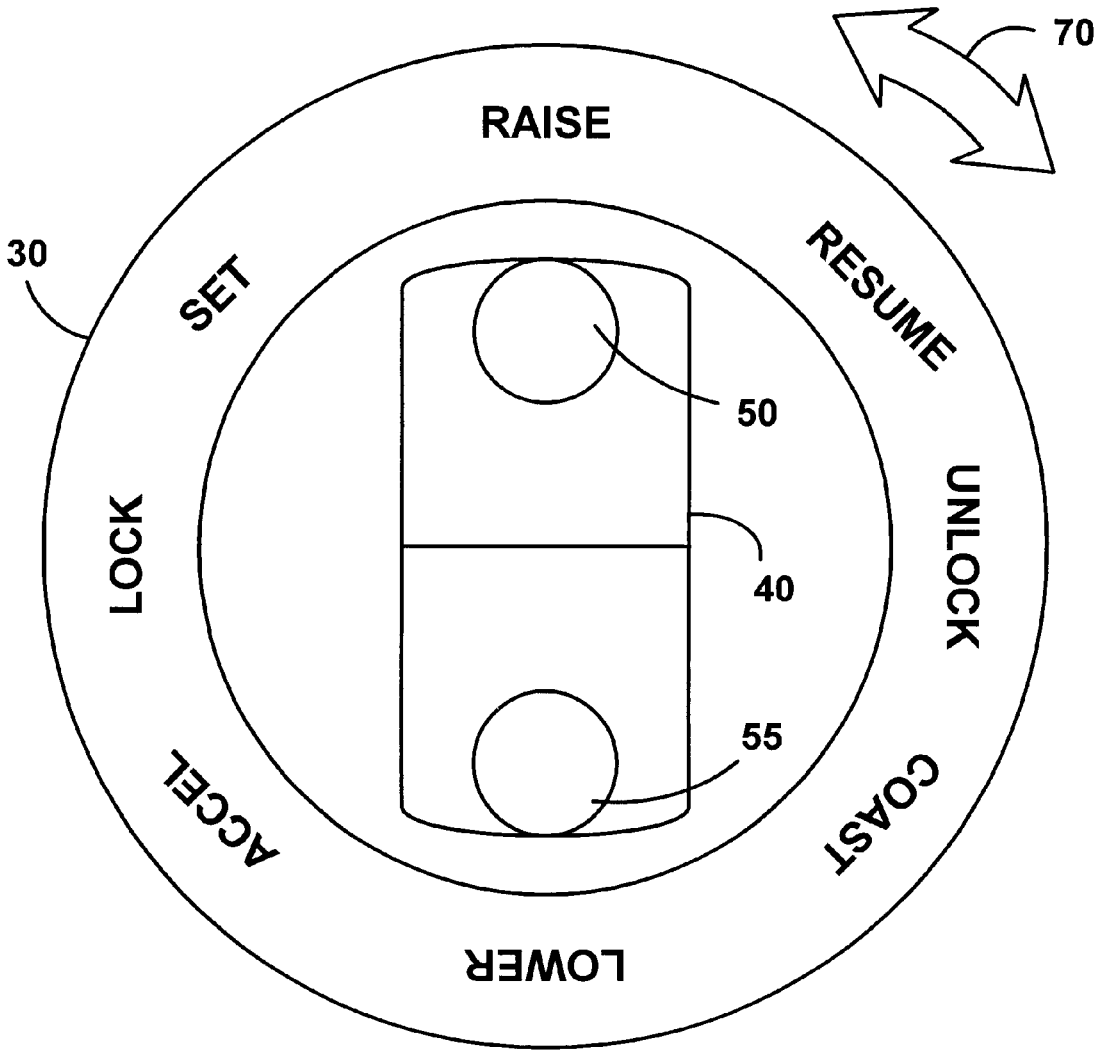
FIG. 3A is a schematic top view of another exemplary embodiment of the multiplexing control device of FIG. 1, that illustrates the use of the multiplexing control device in a control panel in a car, for controlling the operation of the doors, windows, and other instruments.

Surrounding the rocker 40 is the ring 30 that can be rotated in steps relative to the rocker 40, in order to align any two opposing functions labels with the rocker pads 50 and 55, to provide a visual indication to the user as to which functions could be executed by pressing the rocker pads 50 and 55. With further reference to FIG. 3, the two diametrically opposing functions are often logically related. Some of these function pairs are: Page Up and Page Down, Volume Up and Volume Down, Copy and Paste, Forward and backward, Play and Stop, Enter and Delete, etc.

Figure 5:
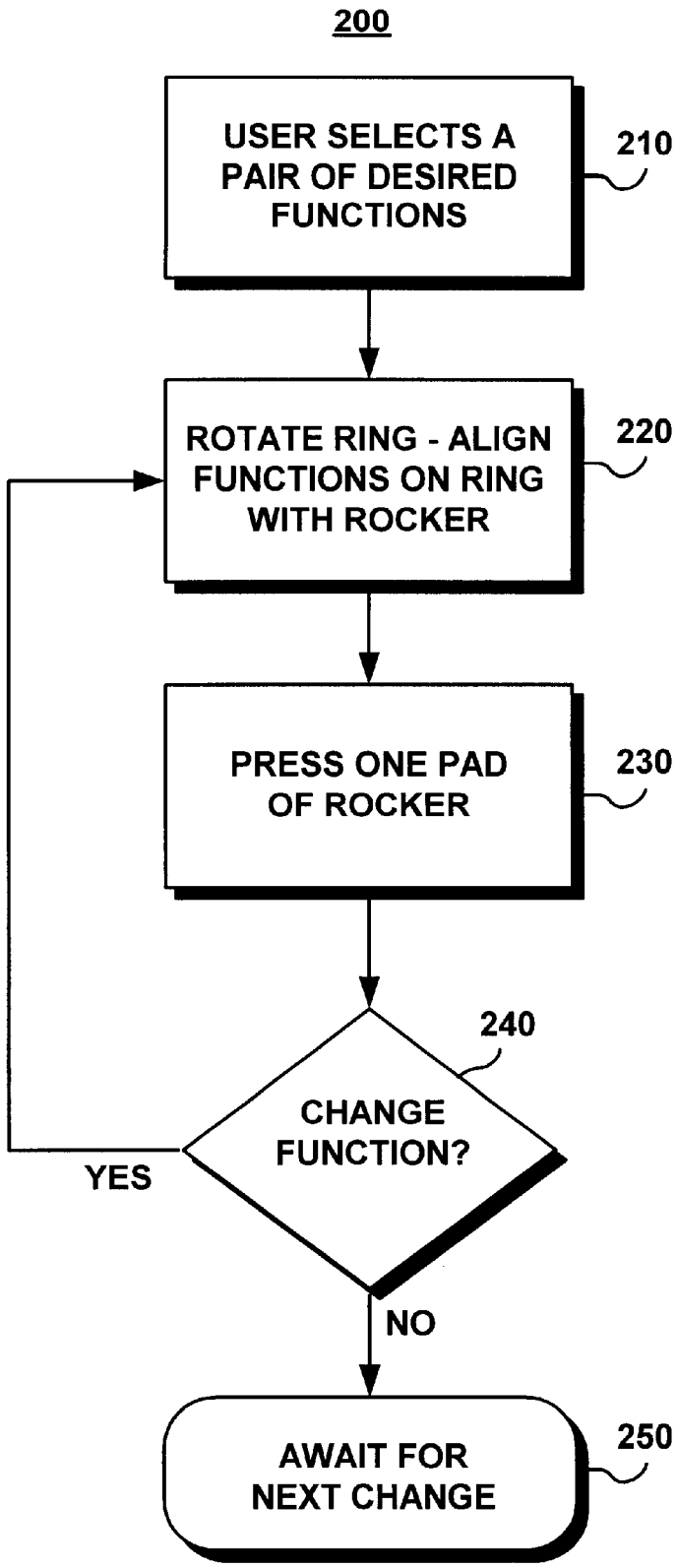
FIG. 5 is a functional flow chart that illustrates the use of the multiplexing control device of FIGS. 1–4.

In use, and as illustrated by a method 200 in FIG. 5, with the multiplexing control device 20 in a resting position, and the rocker 40 is aligned with a pair of functions, such as function A, i.e., Page UP, and function E, i.e., Page Down (FIGS. 2 and 3), the user selects, at step 210, a new pair of desired functions, such as function C, i.e., Copy, and function G, i.e., Paste (FIGS. 2A and 3). To effectuate this selection, the user rotates the ring 30 at step 220, to align the newly selected function pairs {C, G} with the rocker pads 50, 55.

Figure 2B:
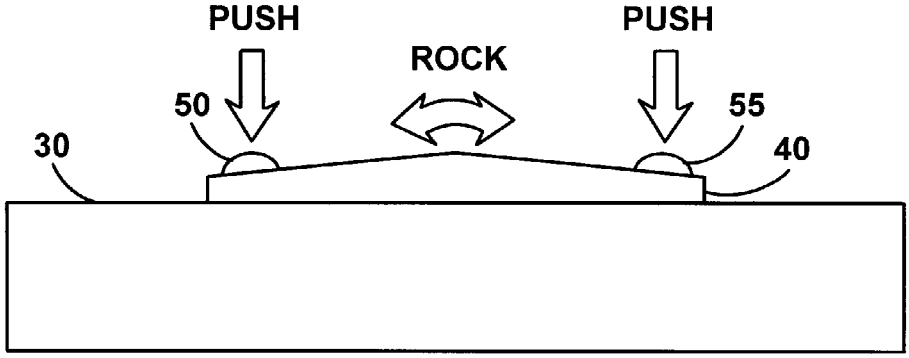
FIG. 2B is a side elevational view of the multiplexing control device of FIGS. 1 and 2, illustrating the command execution step.

At step 230, and with further reference to FIG. 2B, the user executes the desired function by pressing one of the pads 50 or 55 of the rocker 40, in proximity of the desired function label. At step 240, if the user decides to change functions, he or she rotates the ring 30 and executes the new function as explained earlier in connection with steps 220 and 230. Otherwise, the multiplexing control device 20 awaits for the next change from the user, at step 250.

It is therefore apparent that the multiplexing control device 20 offers several advantages. For example, the multiplexing control device 20 provides a simple and clear cognitive model to the user in that the rocker 40 executes the commands that are clearly and visually defined on the ring 30, in alignment with the rocker 40. With minimal practice, the user will easily learn the basic layout of the functions. To further assist the user in learning and recognizing the functions, the functions can be color coded. For example, two diametrically opposed functions can be colored with the same color for ease of association. In another embodiment, each quadrant (or segment) of the multiplexing control device 20 can be colored with a different color. Many color variations and combinations are also possible.

In addition, the multiplexing control device 20 is very efficient as it makes use of the observation that not all the available functions available are used at the same frequency. Depending on the individual and a particular task, the user may use certain functions more than others. To this end, the user simply turns the ring 30 to a particular setting and uses the selected functions. It is quite likely that the user selects a favorite setting without switching to other less frequently used settings.

For example, when a user is watching TV, he or she may turn the ring 30 and keep it at the Channel Up/Channel Down setting. When the user watches a video tape, he or she may turn the ring 10 to the Play/Stop setting. In another example, when the user is listening to a CD player, he or she may turn the ring 30 to the Volume up/Volume down setting. When a user is browsing a long web page, he or she may turn the ring 30 to the Page up/Page down setting. As yet another example, the user may select the Forward/Back setting to be able to scroll through web pages, documents, etc. When, for example, a user is editing a document he or she may turn the ring 30 to the desired most common features such as the Copy/Paste setting.

Yet another feature of the multiplexing control device 20 is the ability to locate the functions by touch, without forcing the user to interrupt the flow of his or her work to look for, and select the desired functions. This feature is enabled by the unique design of the multiplexing control device 20. This design can be further improved by adding certain tactile feedback to the ring 30 and/or the rocker 40 so that the user can "feel" the functions. For example, certain functions labels on the ring 30 can be raised while other labels can be sunken or textured to provide a tactile feedback of the orientation of the ring 30.

Moreover, when the multiplexing control device 20 is part of computer system, the layout of the multiplexing control device 20 can be viewed on the monitor as the user is working on the computer for added visual aid. Such design improvements will be beneficial because the user does not have to look at the multiplexing control device 20. This could be particularly useful for users with motor skill limitations. This latter feature can be implemented by a software program that provides a real time graphical user interface (GUI) of the ring position. For example, whenever the user rotates the ring 30, a animated graphical illustration or menu pops up on the monitor to enable the user to read the function labels on the ring 30 without having to looking at the keyboard 10. When the user completes the function selection on the multiplexing control device 20, the graphical illustration or menu disappears.

Furthermore, while FIG. 1 shows the multiplexing control device 20 as being located at the upper right corner of the keyboard 20, for illustration purposes only, it should be clear that the multiplexing control device 20 can be located at a more convenient location on the keyboard 20, such as in proximity to the space bar, where it is accessible by either thumb. The multiplexing control device 20 can alternatively be located at the lower left corner of the keyboard 20 so the right hand remains in proximity to the mouse. Moreover, the location of the rocker 40 is fixed so the user does not have to search for it among many similar buttons or pads.

Another characteristic feature of the multiplexing control device 20 is the ease with which the functions are changed and assigned to the rocker 40. Though certain keys of conventional devices, such as a computer mouse or a keyboard, are programmable, the reassignment of these functions keys is a tedious task.

The multiplexing control device 20 can be used in a variety of applications, including but not limited to a control panel, a remote device, or any other control device. Each control device may include one or more multiplexing control devices 20, with each multiplexing control device 20 assigned to a separate group of functions.

Figure 4:
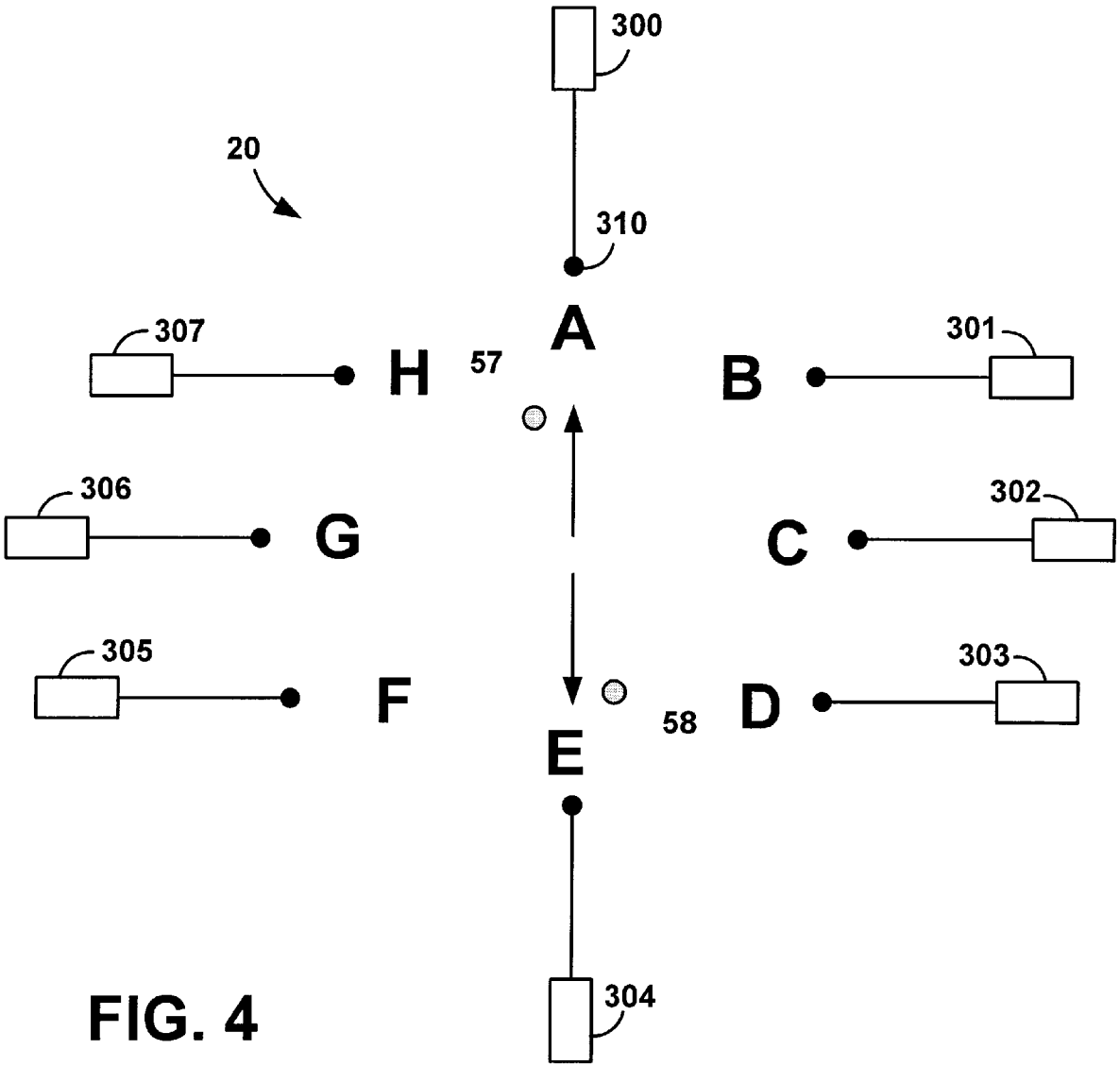
FIG. 4 is a high level exemplary circuit diagram of the multiplexing control device of FIG. 2.

FIG. 4 represents a functional implementation of the multiplexing control device 20 of FIG. 2. The functions A, B, C, D, E, F, G, H on the ring 30 are represented by a plurality of switches 300, 301, 302, 303, 304, 305, 306, 307, respectively. The rocker 40 further includes two contacts 57 and 58, one for each of the pads 50 and 55, respectively. When the pads 50 and 55 are aligned with the desired functions and the user presses one pad, i.e., pad 50, its corresponding contact 57 establishes a mechanical and electrical contact with the contact 310 of the switch 300, completing the selection of the function A and causing it to be executed.

Alternatively, the switches 300, 301, 302, 303, 304, 305, 306, 307 can be input to one or multiple microprocessors capable of implementing functions executed in a software program.

Figure 6:
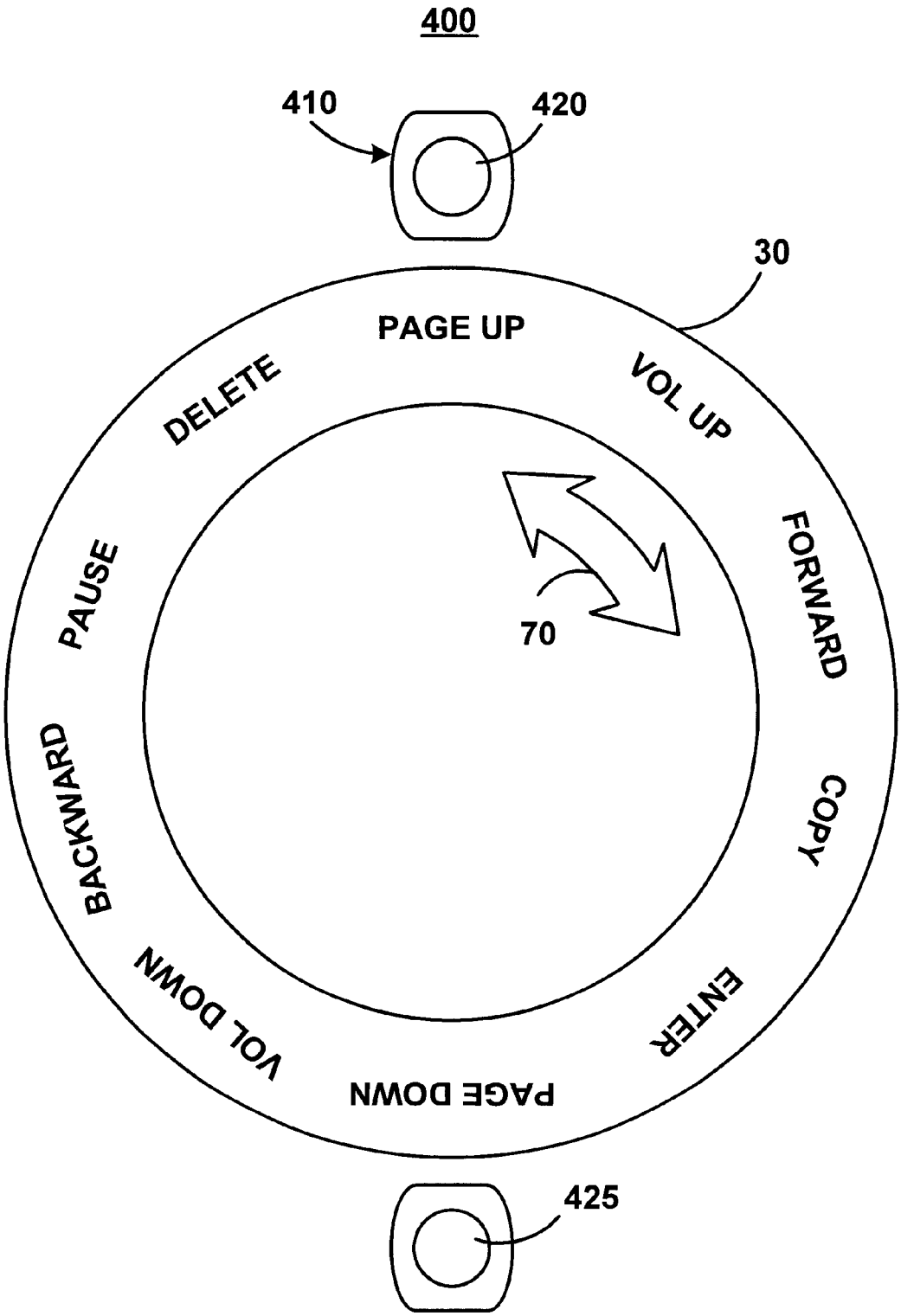
FIG. 6 is a schematic top view of an alternative embodiment of the multiplexing control device of FIG. 2.
Figure 7:
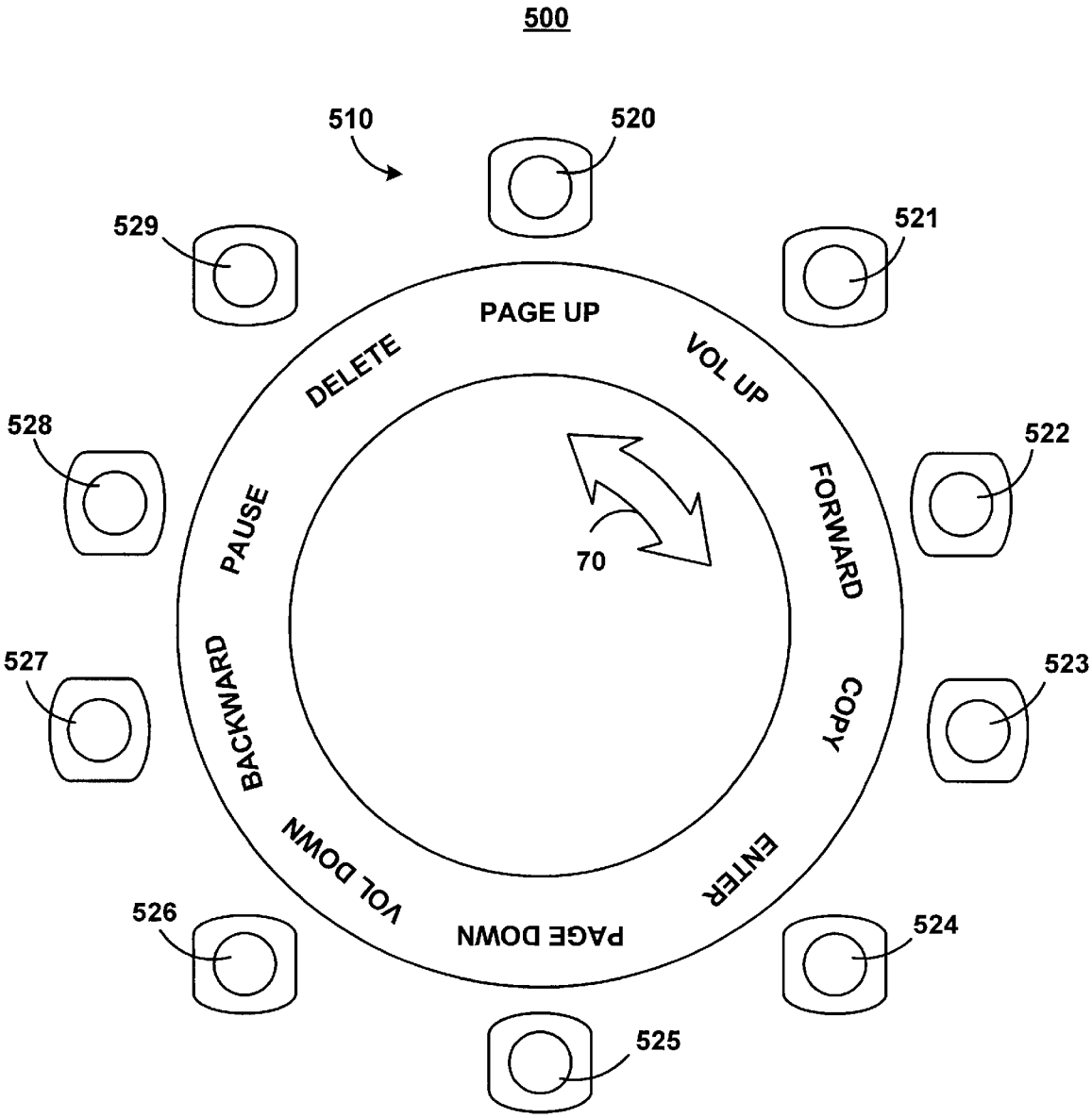
FIG. 7 is a schematic top view of another alternative embodiment of the multiplexing control device of FIG. 2.

FIGS. 6 and 7 illustrate two alternative multiplexing control devices 400 and 500, respectively, both having a similar function and design to the multiplexing control device 20 described earlier. However, the multiplexing control device 400 of FIG. 6 has been modified so that it includes a split rocker 410 provided with two pads 420 and 425 that are located outside the periphery of the ring 30. The pads 420 and 425 have a similar function to that of the pads 50 and 55 of the multiplexing control device 20.

The multiplexing control device 500 of FIG. 7 illustrates a rocker 510 provided with multiple, i.e., three or more, pads 520, 521, 522, 523, 524, 525, 526, 527, 528, 529 that are disposed along the outer periphery of the ring 30.

It is to be understood that the specific embodiments of the invention that have been described are merely illustrative of certain application of the principle of the present invention. Numerous modifications may be made to the multiplexing control device described herein without departing from the spirit and scope of the present invention. For example, while the embodiments of the multiplexing control devices 20, 400, 500 are described herein to include a rotatable ring 30 and a fixed rocker 40, 410, 510, it should be clear from the present description that the ring can be fixed with the rocker being rotatable or that both the ring and the rocker can be rotatable. In addition, the rotating ring 30 could be flipped over doubling the number of functions. For example, the one side of the ring 30 could have word processing functions and the flip side could have Internet browser, CD, or audio controls. Through the use of a mechanical key or optical sensor, the multiplexing control devices 20, 400, 500 could detect and identify the mode (e.g. word processing or Internet browsing) in which they are operating.

In addition, the ring 30 would have generic letters, numbers, or symbols (FIGS. 2 and 2A) that could be assigned (or programmed) various functions by the user via a software configuration utility. When the user selects a function, the letter, number, or symbol would appear on the monitor or a screen with the functions labeled.

What is claimed is:

1. A multiplexing control device comprising:

a selector for allowing a user to manually select a pair of a plurality of functions;

an executor disposed at a fixed location relative to the selector, for causing one function of the pair of functions to be executed; and wherein when the selector selects a pair of functions, the executor is aligned with the selected pair of functions.

2. The multiplexing control device according to claim 1, wherein the selector includes a rotatable ring with labels corresponding to said plurality of functions.

3. The multiplexing control device according to claim 2, wherein the executor includes a rocker disposed inside the ring.

4. The multiplexing control device according to claim 3, wherein the rocker includes two pads; and wherein in a resting position, the pads are aligned with a first pair of said labels corresponding to desired ones of the functions.

5. The multiplexing control device according to claim 4, wherein in a selection position, the ring is rotated so that the pads are aligned with a second pair of said labels corresponding to other desired ones of the functions.

6. The multiplexing control device according to claim 5, wherein one of the desired functions is executed as a result of the application of pressure on one of the pads.

7. The multiplexing control device according to claim 4, wherein the rocker includes at least two pads that are disposed outside the ring.

8. The multiplexing control device according to claim 4, wherein a selected pair of the functions includes functions that are logically related.

9. The multiplexing control device according to claim 8, wherein the first pair of the labels are diametrically and oppositely disposed relative to the rocker.

10. The multiplexing control device according to claim 3, wherein the rocker includes three pads; and wherein in a resting position, the pads are aligned with three of the labels corresponding to desired ones of the functions.

11. A multiplexing control device comprising:

a selector including labels corresponding to a plurality of functions, for allowing a user to manually select a pair of the plurality of functions;

an executor for causing one function of the pair of functions to be executed; and wherein when the selector selects a pair of the functions, the executor is aligned with the selected pair of the functions.

12. The multiplexing control device according to claim 11, wherein the selector includes a ring.

13. The multiplexing control device according to claim 12, wherein the ring is fixed relative to a rocker;

wherein the rocker is rotatable relative to the ring; and wherein the executor include the rocker disposed inside the ring.

14. The multiplexing control device according to claim 13, wherein the rocker includes two pads; and wherein in a resting position, the pads are aligned with a first pair of the labels on the ring.

15. The multiplexing control device according to claim 14, wherein in a selection position, the rocker is rotated so that the pads are aligned with a second pair of the labels on the ring.

16. The multiplexing control device according to claim 15, wherein a desired one of the functions is executed as a result of the application of pressure on one of the pads.

17. The multiplexing control device according to claim 14, wherein the rocker includes at least two pads that are disposed outsider the ring.

18. The multiplexing control device according to claim 14, wherein a selected pair of the functions includes functions that are logically related.

19. The multiplexing control device according to claim 18, wherein the first pair of the labels are diametrically and oppositely disposed relative to the rocker.

20. The multiplexing control device according to claim 13, wherein the rocker includes three pads; and wherein in a resting position, the pads are aligned with three of the functions labels on the ring.

* * * * *